US008723783B2

(12) United States Patent
Yeo et al.

(10) Patent No.: US 8,723,783 B2
(45) Date of Patent: May 13, 2014

(54) LIQUID CRYSTAL DISPLAY AND METHOD OF DRIVING THE SAME

(75) Inventors: Dong-Min Yeo, Asan-si (KR); Byung-Choon Yang, Seoul (KR); Young-Jun Seo, Seoul (KR); Yong-Hoon Kwon, Asan-si (KR)

(73) Assignee: Samsung Display Co., Ltd., Yongin (KR)

( * ) Notice: Subject to any disclaimer, the term of this patent is extended or adjusted under 35 U.S.C. 154(b) by 192 days.

(21) Appl. No.: 12/961,103

(22) Filed: Dec. 6, 2010

(65) Prior Publication Data

US 2011/0134168 A1 Jun. 9, 2011

(30) Foreign Application Priority Data

Dec. 7, 2009 (KR) ..... 10-2009-0120821

(51) Int. Cl.
*G09G 3/36* (2006.01)

(52) U.S. Cl.
USPC ..... 345/102; 349/61; 362/97.2

(58) Field of Classification Search
USPC ..... 345/102; 349/61–71; 362/97.1–97.4
See application file for complete search history.

(56) References Cited

U.S. PATENT DOCUMENTS

2008/0198114 A1* 8/2008 Roberts et al. ..... 345/88
2008/0273005 A1* 11/2008 Chen et al. ..... 345/102

FOREIGN PATENT DOCUMENTS

| | | |
|---|---|---|
| JP | 2005077691 | 3/2005 |
| KR | 1020070081018 | 8/2007 |
| KR | 1020070100040 | 10/2007 |
| KR | 1020080085272 | 9/2008 |

* cited by examiner

*Primary Examiner* — Michael Pervan
(74) *Attorney, Agent, or Firm* — H.C. Park & Associates, PLC

(57) ABSTRACT

A liquid crystal display (LCD) includes: a light source unit to provide light to a liquid crystal panel and includes first point light sources and second point light sources; a first timing controller to transmit a first image signal and a second image signal to the liquid crystal panel; a second timing controller to transmit optical data, which includes first information to turn on the first point light sources and the second point light sources at different times; and a light source driver to control the first point light sources and the second point light sources to be turned on and off according to the optical data. A method of driving an LCD includes turning on and off first and second point light sources according to received first and second image signals.

12 Claims, 15 Drawing Sheets

LIQUID CRYSTAL DISPLAY AND METHOD OF DRIVING THE SAME

This application claims priority from and the benefit of Korean Patent Application No. 10-2009-0120821, filed on Dec. 7, 2009, which is hereby incorporated by reference for all purposes as if fully set forth herein.

BACKGROUND

1. Field

Exemplary embodiments of the present invention relate to a liquid crystal display (LCD) and a method of driving the same.

2. Discussion of the Background

A liquid crystal display (LCD) includes a first display substrate having a pixel electrode, a second display substrate having a common electrode, and a liquid crystal panel having a dielectrically anisotropic liquid crystal layer injected between the first and second display substrates. The LCD displays a desired image by forming an electric field between the pixel electrode and the common electrode and adjusting the intensity of the electric field to control the amount of light that passes through the liquid crystal panel.

Since an LCD is not a self light-emitting display, LCDs include a plurality of light-emitting devices. A timing controller provides optical data to control each light-emitting device.

SUMMARY

Exemplary embodiments of the present invention provide a liquid crystal display (LCD) having an increased color reproducibility.

Exemplary embodiments of the present invention also provide a method of driving an LCD having an increased color reproducibility.

However, aspects of the present invention are not restricted to the exemplary embodiments set forth herein. Additional features of the invention will be set forth in the description which follows, and in part will be apparent from the description, or may be learned by practice of the invention.

An exemplary embodiment of the present invention discloses an LCD including; a light source unit to provide light to the liquid crystal panel, the light source unit including first point light sources and second point light sources; a first timing controller to transmit a first image signal to the liquid crystal panel and a second image signal to the liquid crystal panel; a second timing controller to transmit optical data, the optical data comprising first information to turn on the first point light sources and the second point light sources at different times; and a light source driver to control the first point light sources and the second point light sources according to the optical data, wherein the first point light sources are turned on for at least a portion of a period of time in which the first image signal is transmitted to the liquid crystal panel, and the second point light sources are turned on for at least a portion of a period of time in which the second image signal is transmitted to the liquid crystal panel.

An exemplary embodiment of the present invention discloses a method of driving an LCD, the LCD including a liquid crystal panel, a light source driver, and a light source unit comprising first point light sources and second point light sources, the method including transmitting a first image signal to the liquid crystal panel and a second image signal to the liquid crystal panel; transmitting optical data to the light source driver, the optical data including first information to turn on the first point light sources and the second point light sources at different times; and controlling the first point light sources and the second point light sources to be turned on and off according to the optical data, wherein the first point light sources are turned on for at least a portion of a period of time in which the first image signal is transmitted to the liquid crystal panel, and the second point light sources are turned on for at least a portion of a period of time in which the second image signal is transmitted to the liquid crystal panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
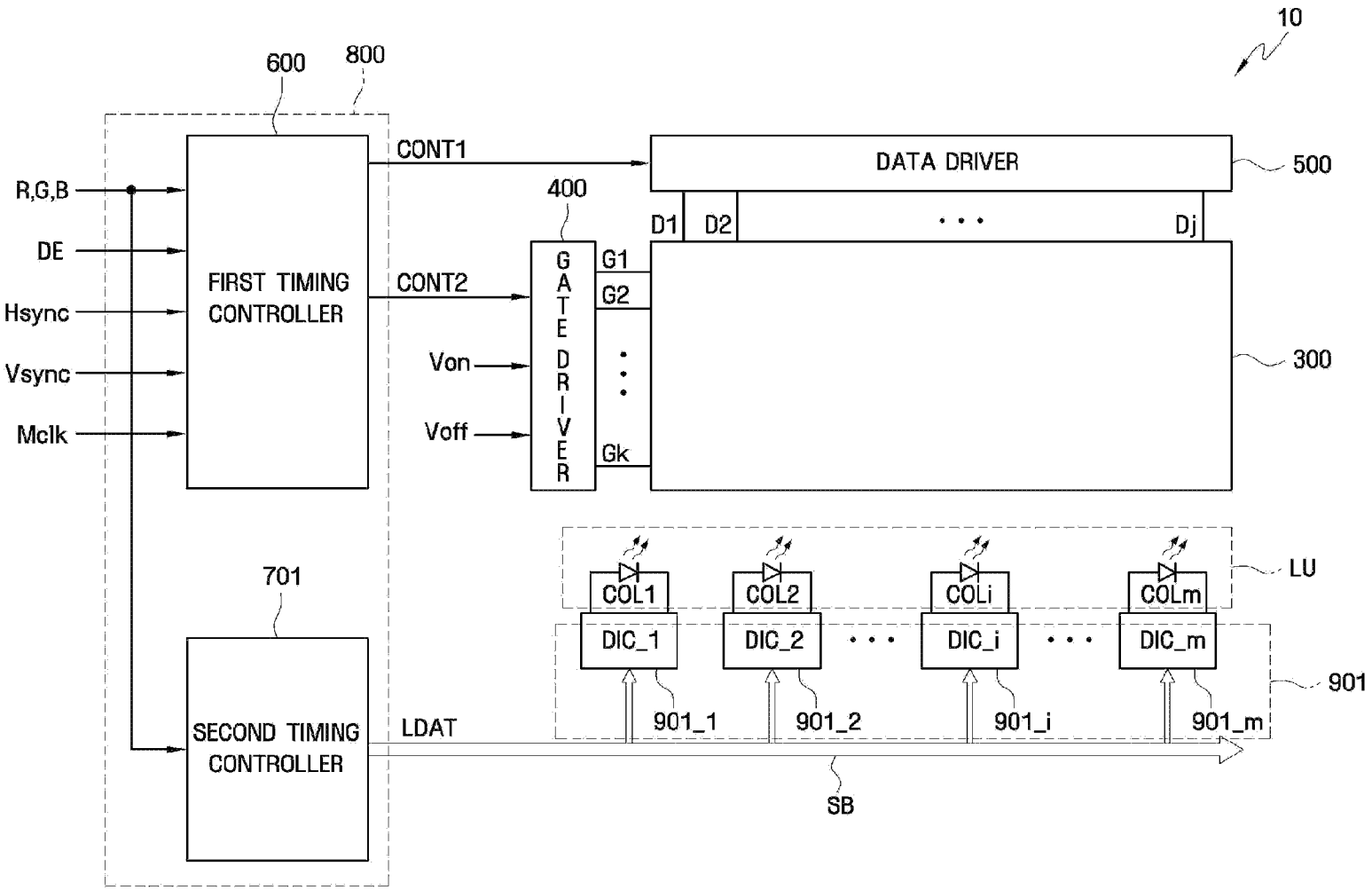
FIG. 1 is a block diagram of a liquid crystal display (LCD) according to an exemplary embodiment of the present invention.

The invention is described more fully hereinafter with reference to the accompanying drawings, in which embodiments of the invention are shown. This invention may, however, be embodied in many different forms and should not be construed as being limited to the embodiments set forth herein. Rather, these embodiments are provided so that this disclosure will be thorough, and will fully convey the scope of the invention to those skilled in the art. In the drawings, sizes and relative sizes of layers and regions may be exaggerated for clarity. Like reference numerals in the drawings denote like elements.

It will be understood that when an element or layer is referred to as being "on" or "connected to" another element or layer, the element or layer can be directly on or directly connected to the other element or layer, or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

Spatially relative terms, such as "below," "beneath," "lower," "above," "upper," and the like, may be used herein for ease of description to describe one device or element's relationship to another device(s) or element(s) as illustrated in the drawings. It will be understood that the spatially relative terms are intended to encompass different orientations of the device in use or operation in addition to the orientation depicted in the drawings.

Exemplary embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, exemplary embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

Hereinafter, a liquid crystal display (LCD) and a method of driving the same according to exemplary embodiments of the present invention will be described with reference to FIGS. 1 through 10D.

Figure 2:
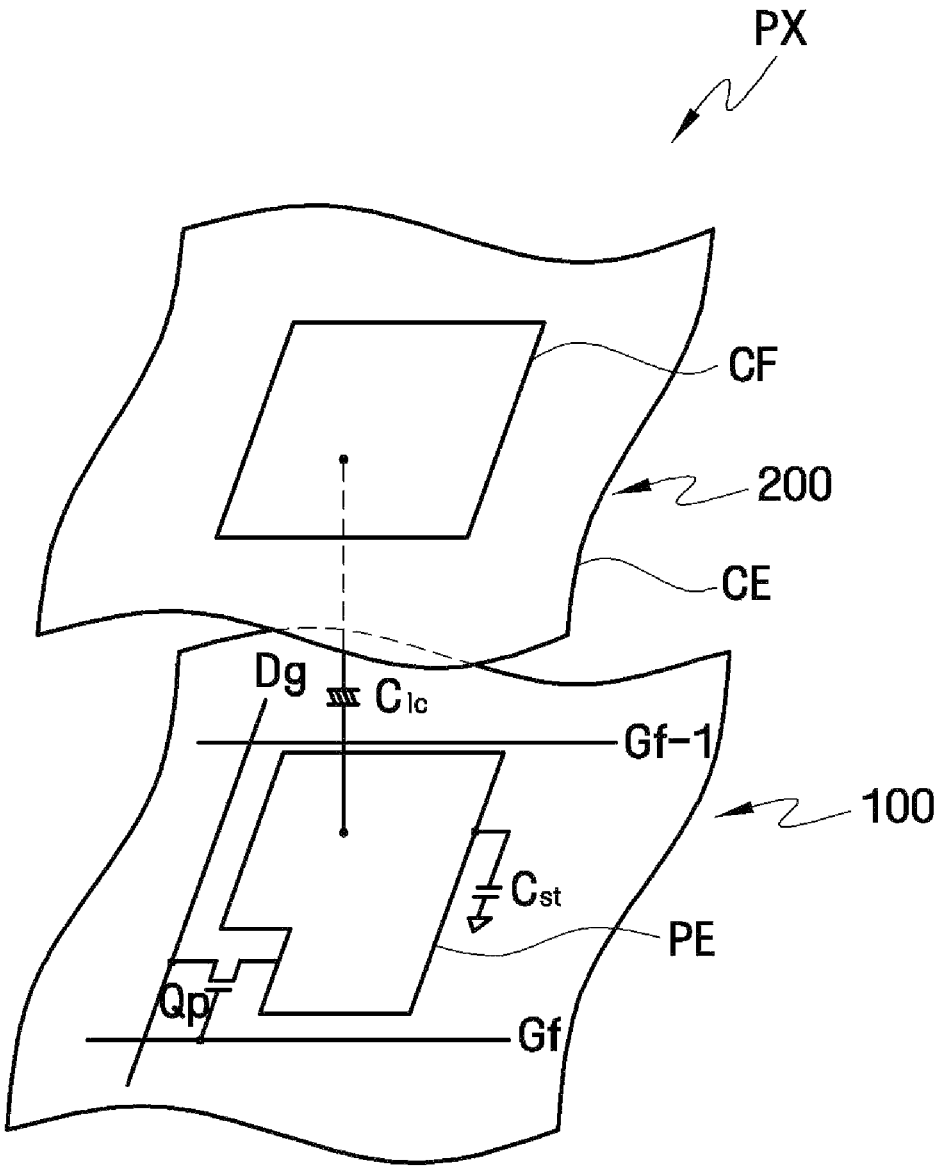
FIG. 2 is an equivalent circuit diagram of a pixel.
Figure 3:
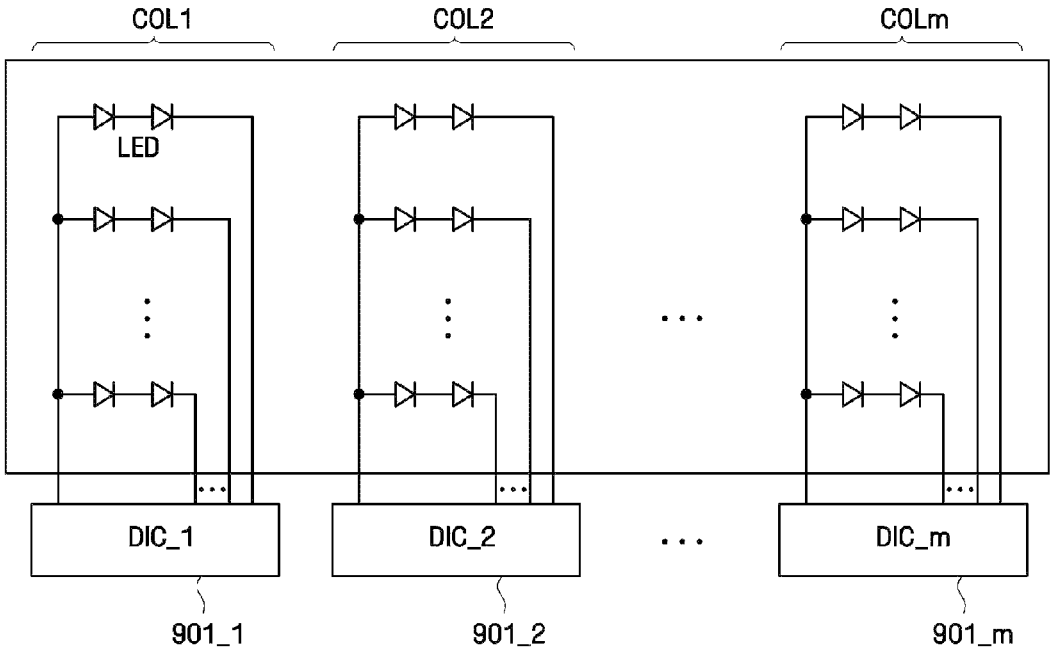
FIG. 3 is a block diagram of a light source unit and a light source driver shown in FIG. 1.
Figure 4:
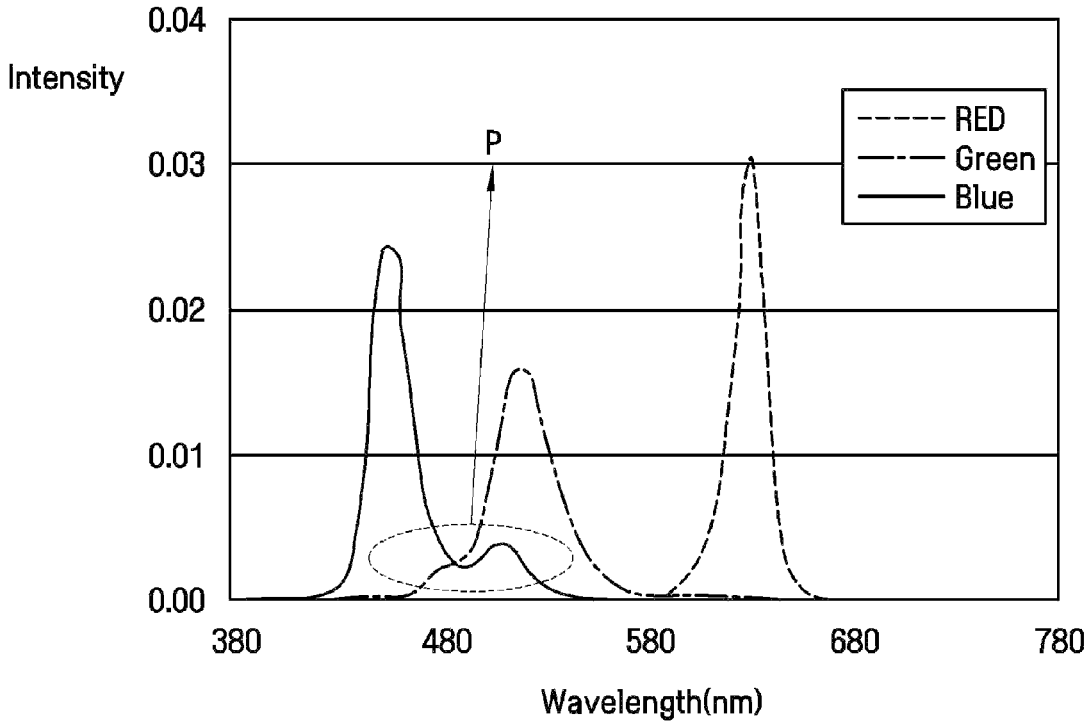
FIG. 4 is a graph illustrating a cause of deterioration of color reproducibility.

First, an LCD 10 according to an exemplary embodiment of the present invention will be described with reference to FIG. 1, FIG. 2, FIG. 3, and FIG. 4. FIG. 1 is a block diagram of the LCD 10 according to an exemplary embodiment of the present invention. FIG. 2 is an equivalent circuit diagram of a pixel. FIG. 3 is a block diagram of a light source unit LU and a light source driver 901 shown in FIG. 1. FIG. 4 is a graph illustrating a cause of deterioration of color reproducibility.

Referring to FIG. 1, the LCD 10 includes a timing controller unit 800, the light source driver 901, a gate driver 400, a data driver 500, a liquid crystal panel 300, and the light source unit LU.

A plurality of pixels is arranged in the liquid crystal panel 300. The liquid crystal panel 300 includes a plurality of gate lines G1 through Gk and a plurality of data lines D1 through Dj. Each pixel of the liquid crystal panel 300 responds to first image information and second image information received from a first timing controller 600. In addition, each pixel of the liquid crystal panel 300 receives light from the light source unit LU. Accordingly, an image is displayed on the liquid crystal panel 300.

Referring to the equivalent circuit diagram of FIG. 2, a pixel PX may be connected to, for example, an $f^{th}$ (f=1 to k) gate line Gf and a $g^{th}$ (g=1 to j) data line Dg. In addition, the pixel PX may include a switching device Qp, which is connected to the $f^{th}$ gate line Gf and the $g^{th}$ data line Dg, and a liquid crystal capacitor Clc and a storage capacitor Cst, which are each connected to the switching device Qp. The liquid crystal capacitor Clc may include a pixel electrode PE formed on a first display substrate 100 and a common electrode CE formed on a second display substrate 200. A color filter CF may be formed in a region corresponding to or aligning with the common electrode CE.

Referring to FIG. 1, the gate driver 400 receives a gate control signal CONT2 from the first timing controller 600 and transmits a gate signal to each of the gate lines G1 through Gk. Here, the gate signal may be a gate-on voltage Von or a gate-off voltage Voff produced by a gate on/off voltage generator (not shown).

The gate control signal CONT2 controls the operation of the gate driver 400. The gate control signal CONT2 may include a vertical start signal to start the operation of the gate driver 400, a gate clock signal that determines the output timing of the gate-on voltage Von, and an output enable signal that determines the pulse width of the gate-on voltage Von.

The data driver 500 receives a data control signal CONT1 from the first timing controller 600 and applies an image data voltage to each of the data lines D1 through Dj. The data control signal CONT1 may include image signals that correspond to red, green, and blue signals R, G, and B, and a signal to control the operation of the data driver 500. The signal to control the operation of the data driver 500 may include a horizontal start signal to start the operation of the data driver 500 and an output instruction signal that determines the output of the image data voltage.

The gate driver 400 or the data driver 500 may be mounted on a flexible printed circuit film (not shown) and may be attached to the liquid crystal panel 300 in the form of a tape carrier package. Alternatively, the gate driver 400 or the data driver 500 may be integrated on the liquid crystal panel 300, together with display signal lines (i.e., the gate lines G1 through Gk and the data lines D1 through Dj) and the switching device Qp.

The light source unit LU emits light. And, the light source unit LU includes a light-emitting device. The light-emitting device may be a point light source, such as a light-emitting diode (LED). Here, the light source unit LU may include a plurality of point light sources. The point light sources may include a plurality of first point light sources to emit green light, a plurality of second point light sources to emit blue light, and a plurality of third point light sources to emit red light. Alternatively, the point light sources may include a plurality of first point light sources to emit green light and a plurality of second point light sources to emit magenta light, i.e., a mixture of blue light and red light. The first point light sources need not always emit green light. For example, the second point light sources may also emit green light. Further, the first point light sources may emit magenta light. Hereinafter, exemplary embodiments of the present invention will be described such that the first point light sources emit magenta light and that the second point light sources emit green light.

An image displayed on the liquid crystal panel 300 may include a plurality of frames. When an image including a plurality of frames is displayed on the liquid crystal display 300, the first and second point light sources of the light source unit LU may be turned on at different times within one frame of the image. That is, in one frame, the first point light sources may be turned on at a first time, and the second point light sources may be turned on at a second time that is different from the first time. Thus, the second point light sources may remain turned off at the first time when the first point light sources are turned on, and the first point light sources may remain turned off at the second time when the second point light sources are turned on.

In addition, a period of time during which all of the first and second point light sources are turned off may be included between the first time and the second time. For example, the first and second point light sources may all be turned off after the first point light sources are turned on and before the second point light sources are turned on. The light source driver 901 may control the first and second point light sources included in the light source unit LU to be turned on and off.

The timing controller unit 800 may be divided into the first timing controller 600 and a second timing controller 701. The first timing controller 600 may control an image displayed on the liquid crystal panel 300, and the second timing controller 701 may provide optical data LDAT to the light source driver 901. The first timing controller 600 and the second timing controller 701 may not be physically separated from each other, i.e., the first timing controller 600 and the second timing controller 701 may be one unit. Alternatively, the first timing controller 600 and the second timing controller 701 may be physically separated from each other.

The first timing controller 600 receives from an external graphics controller (not shown) the red, green, and blue signals R, G, and B and external control signals to control the display of the red, green, and blue signals R, G, and B. According to the red, green, and blue signals R, G, and B and the external control signals, the first timing controller 600 generates the data control signal CONT1 and the gate control signal CONT2. Examples of the external control signals include a vertical synchronization signal Vsync, a horizontal synchronization signal Hsync, a main clock signal Mclk, and a data enable signal DE.

In addition, the first timing controller 600 provides the received red, green, and blue signals R, G, and B to the liquid crystal panel 300 via the data driver 500. Of the red, green, and blue signals R, G, and B, the green signal may be designated as a first image signal, the blue signal may be designated as a second image signal, and the red signal may be designated as a third image signal. Alternatively, the green signal may be designated as the first image signal, and the blue and red signals may simultaneously be designated as the second image signals. However, the green signal need not always be the first image signal. For example, the green signal may be the second image signal, and the blue and red signals may be the first image signals. Accordingly, a wavelength range of a first color represented by the first image signal may be a wavelength range of magenta, which is a mixture of red and blue, or a wavelength range of green. In addition, a wavelength range of a second color represented by the second image signal may be a wavelength range of magenta, which is a mixture of red and blue, or a wavelength range of green.

Hereinafter, exemplary embodiments of the present invention will be described such that the first image signal is a mixture of the blue and red signals representing magenta and that the second image signal is the green signal representing green.

The first image signal and the second image signal may be transmitted to the liquid crystal panel 300 at different times by the first timing controller 600. For example, the first image signal may be transmitted to the liquid crystal panel 300 at the first time, and the second image signal may be transmitted to the liquid crystal panel 300 at the second time.

When the first image signal is transmitted to the liquid crystal panel 300 at the first time, the first point light sources of the light source unit LU may be turned on for at least a portion of a period of time in which the first image signal is transmitted to the liquid crystal panel 300. In addition, when the second image signal is transmitted to the liquid crystal panel 300, the second point light sources of the light source unit LU may be turned on for at least a portion of a period of time in which the second image signal is transmitted to the liquid crystal panel 300.

The wavelength range of the first color represented by the first image signal may be the same as that of light emitted from the first point light sources. For example, when the first image signal is transmitted to the liquid crystal panel 300, the first color represented by the first image signal may be magenta as the first image signal is a mixture of the blue and red signals. If the first image signal is transmitted, the first point light sources are turned on. Accordingly, the first point light sources may be light-emitting devices that emit magenta light. For example, the first color represented by the first image signal and the color of light emitted from the first point light sourced may be magenta. Thus, the wavelength range of the first color represented by the first image signal may be the same as that of light emitted from the first point light sources.

Likewise, the wavelength range of the second color represented by the second image signal may be the same as that of light emitted from the second point light sources. The second color represented by the second image signal may be green, and the color of light emitted from the second point light sources may be green. Thus, since the second color represented by the second image signal and the color of light emitted from the second point light sources are green, the wavelength range of the second color represented by the second image signal may be the same as that of light emitted from the second point light sources.

The second timing controller 701 may receive the red, green, and blue signals R, G, and B and transmit the optical data LDAT to the light source driver 901 through a serial bus SB. The serial bus SB may be, for example, an inter integrated circuit (I2C) bus. The second timing controller 701 may transmit the optical data LDAT to the light source driver 901 using not only the serial bus SB but also various devices and/or methods.

The optical data LDAT may include first information and second information. The first information may indicate that the first and second point light sources are to be turned on at different times. In addition, the first information may include information indicating that the second point light sources are to be turned off when the first point light sources are turned on and information indicating that the first point light sources are to be turned off when the second light sources are turned on.

The second information may indicate that all of the first and second point light sources are to be turned off. That is, in response to the second information, all of the first and second point light sources may be turned off after the first point light sources are turned on and before the second point light sources are turned on. Alternatively, in response to the second information, all of the first and second point light sources may be turned off after the second point light sources are turned on and before the first point light sources are turned on.

The light source driver 901 controls the first and second point light sources included in the light source unit LU to be turned on and off in response to the optical data LDAT. Referring to FIG. 3, the light source driver 901 may include a plurality of sub light source drivers 901_1 through 901_*m*. That is, the first and second point light sources of the light source unit LU may be divided into a plurality of columns COL1 through COLm, and the sub light source drivers 901_1 through 901_*m* may be disposed at positions corresponding to the columns COL1 through COLm, respectively. Accordingly, since the first and second point light sources of the light source unit LU may be driven on a column-by-column basis, the overall driving efficiency of the light source unit LU may be improved.

FIG. 4 illustrates the wavelength distribution of light emitted from point light sources. Referring to FIG. 4, blue may have a first wavelength range of approximately 380 nm to 540 nm, green may have a second wavelength range of approximately 430 nm to 620 nm, and red may have a third wavelength range of approximately 580 nm to 680 nm.

Here, a sub peak of the first wavelength range of blue and a sub-peak of the second wavelength range of green may overlap in a region P. Accordingly, when an image displayed on the liquid crystal panel 300 includes spatially mixed colors, it may be difficult to accurately represent the color of the image. That is, when green and blue are represented simultaneously, the sub peak of the first wavelength range of blue and the sub peak of the second wavelength range of green may overlap, which results in color mixture. Thus, a pixel, which should represent blue, may represent green, or vice versa. Consequently, it may be difficult to clearly represent blue and green. However, if blue and green are driven at different times, the first wavelength range of blue can be prevented from overlapping the second wavelength range of green.

However, the first wavelength range of blue and the third wavelength range of red do not substantially overlap. Thus, problems associated with color mixture may not occur. Accordingly, the clearness of color representation may not decrease if magenta is driven by mixing blue and red.

As described above, the first point light sources emit magenta light. Thus, the first point light sources may emit light including the first wavelength range, which indicates blue light, in magenta light. In addition, because the second point light sources emit green light, the second point light sources may emit light including the second wavelength range, which indicates green light. However, aspects are not limited thereto such that the opposite may be possible. Here, the first wavelength range and the second wavelength range may partially overlap each other.

Meanwhile, because the first point light sources emit magenta light, the first point light sources may include LEDs that emit blue light. In addition, because the second point light sources emit green light, the second point light sources may include LEDs that emit green light.

Figure 5:
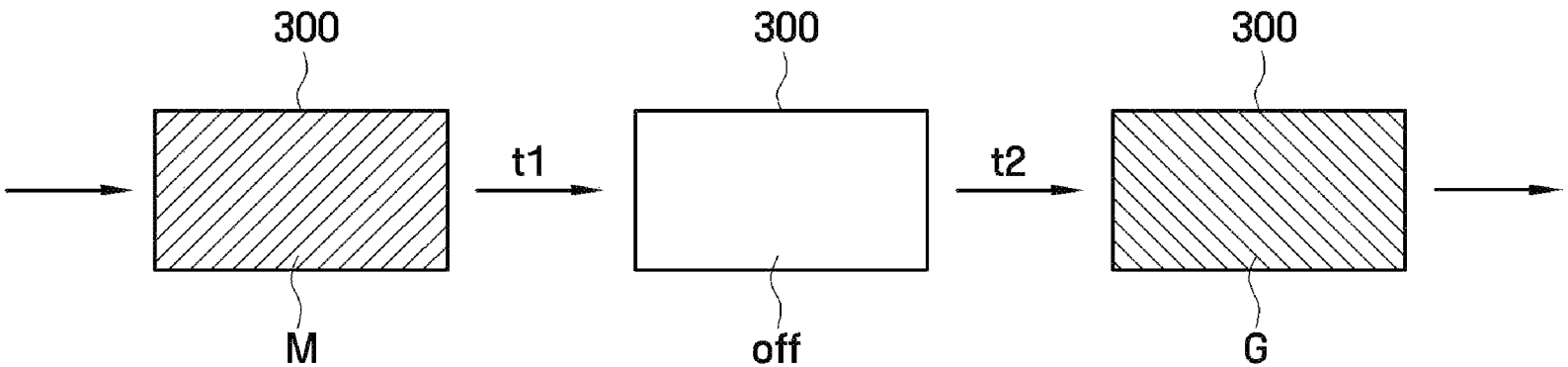
FIG. 5 is a block diagram illustrating a method of driving an LCD according to an exemplary embodiment of the present invention.

A method of driving an LCD according to an exemplary embodiment of the present invention will now be described with reference to FIGS. 5 through 7. FIG. 5 is a block diagram illustrating the method of driving the LCD according to an exemplary embodiment of the present invention. FIG. 6A, FIG. 6B, and FIG. 6C are diagrams illustrating a method of displaying a frame on a liquid crystal panel 300 according to an exemplary embodiment of the present invention. FIG. 7 is a diagram illustrating a process of driving the LCD according to an exemplary embodiment of the present invention.

Referring to FIG. 5, the method of driving the LCD including the liquid crystal panel 300 and a light source unit LU, which includes a plurality of first point light sources and a plurality of second light sources, includes transmitting first and second image signals to the liquid crystal panel 300, transmitting optical data, which includes first information indicating that the first and second point light sources are to be turned on at different times, to a driver, and controlling the first and second light sources to be turned on and off in response to the optical data. If the first image signal is transmitted to the liquid crystal panel 300, the first point light sources are turned on. If the second image signal is transmitted to the liquid crystal panel 300, the second point light sources are turned on.

Specifically, the first image signal is transmitted to the liquid crystal panel 300. The first image signal may include a signal that represents, for example, magenta on the liquid crystal panel 300. Accordingly, magenta may be displayed on the liquid crystal panel 300.

If the first image signal is transmitted to the liquid crystal panel 300, the optical data, which includes the first information indicating that the first point light sources should be turned on, may be provided to the driver, for example, a driver of a light source unit LU, so that the first point light sources emit magenta light. Accordingly, the first point light sources of the light source unit LU emit magenta light such that the liquid crystal panel 300 displays magenta M.

After a first time t1, optical data including second information is provided to the light source unit LU. As described above, the second information indicates that all of the first and second point light sources are to be turned off. Accordingly, the first and second point light sources included in the light source unit LU are turned off for a period of time such that the liquid crystal panel emits little or no light (off in FIG. 5).

After a second time t2, the second image signal is transmitted to the liquid crystal panel 300. The second image signal may include a signal that represents, for example, green on the liquid crystal panel 300. Accordingly, green G may be displayed on the liquid crystal panel 300.

If the second image signal is transmitted to the liquid crystal panel 300, the optical data, which includes the first information indicating that the second point light sources are to be turned on, is transmitted to the light source unit LU so that the second point light sources emit green light. Accordingly, the second point light sources of the light source unit LU emit green light such that the liquid crystal panel 300 displays green G.

Through the above processes, a frame is formed on the liquid crystal panel 300. As described above, blue included in magenta and green are driven at different times. Thus, the wavelength range of blue and the wavelength range of green can be prevented from overlapping, thereby preventing deterioration of color reproducibility. In addition, a period of time during which the first and second point light sources of the light source unit LU are turned off is included between the representations of magenta and green; thus the overlap of the wavelength ranges of blue and green may be decreased and the margin of color representation is increased. Consequently, color reproducibility of the liquid crystal panel 300 may be enhanced.

Figure 6A:
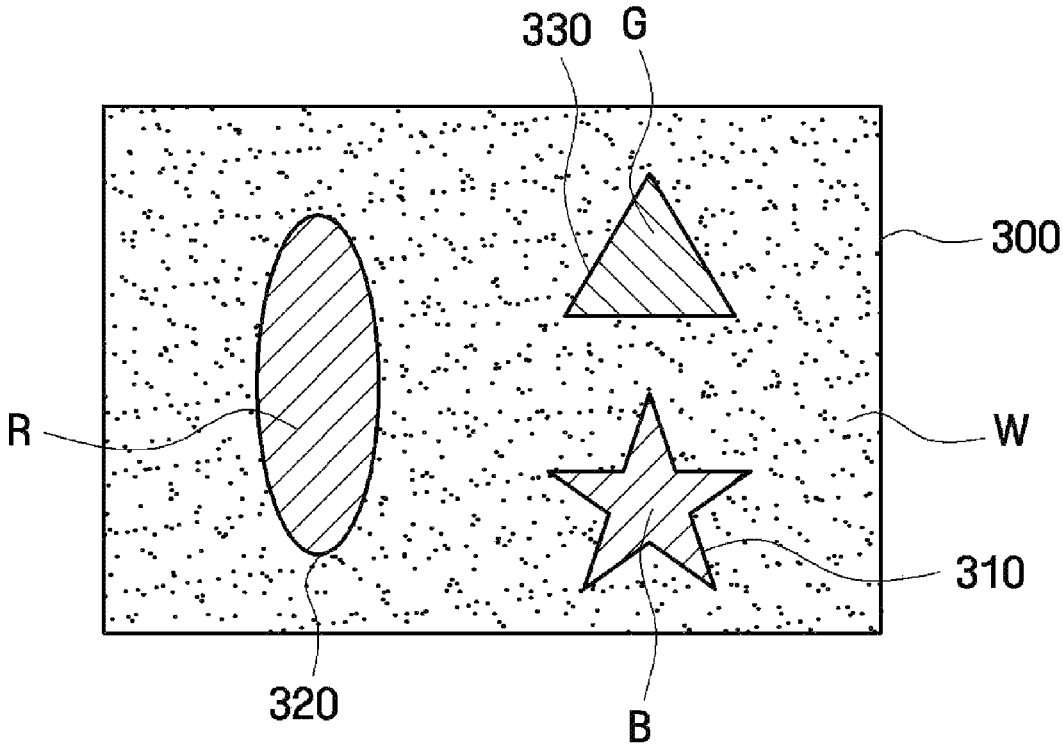
FIG. 6A, FIG. 6B, and FIG. 6C are diagrams illustrating a method of displaying a frame on a liquid crystal panel according to an exemplary embodiment of the present invention.
Figure 7:
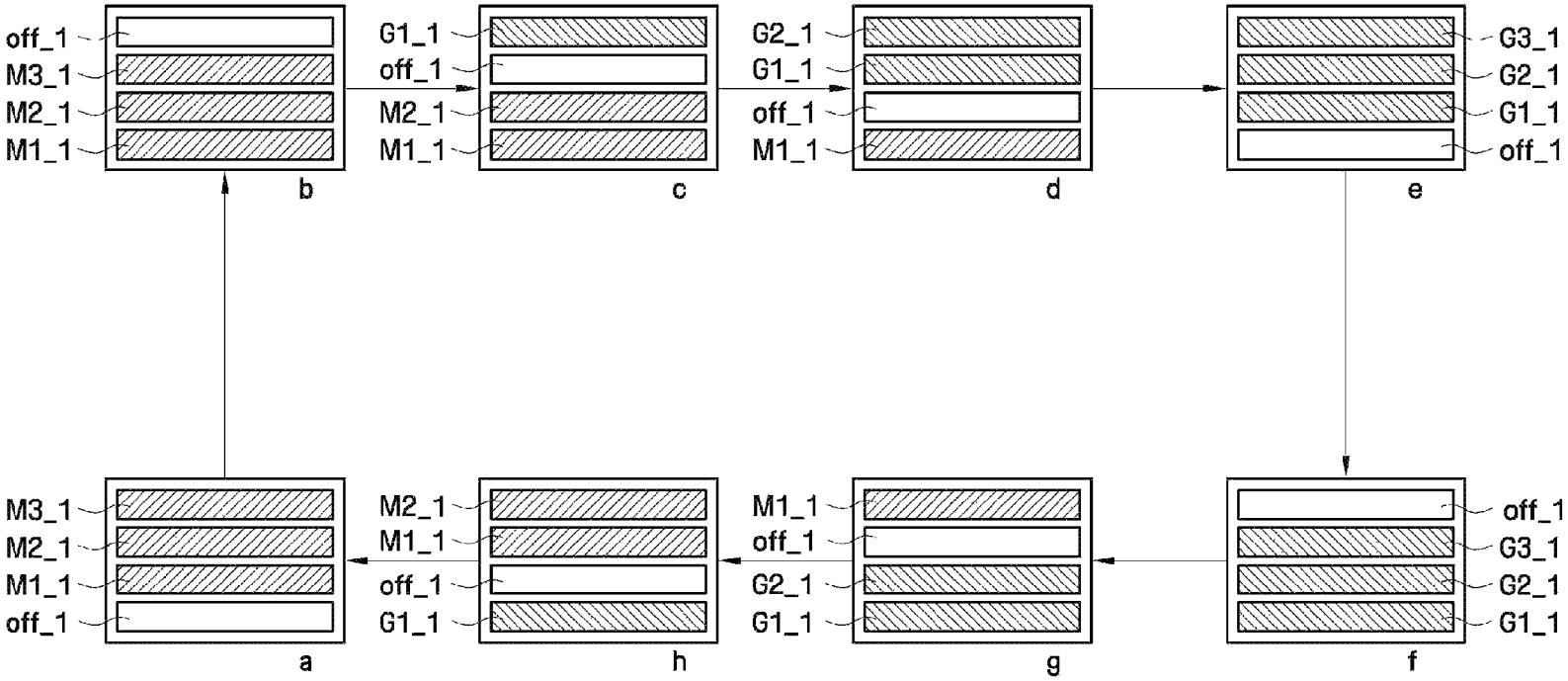
FIG. 7 is a diagram illustrating a process of driving the LCD according to the second exemplary embodiment of the present invention.

Referring to FIG. 6A, a frame formed on the liquid crystal panel 300 may include a first FIG. 310, a second FIG. 320, and a third FIG. 330 on a white W background. Here, the first FIG. 310 is blue B, the second FIG. 320 is red R, and the third FIG. 330 is green G.

Figure 6B:
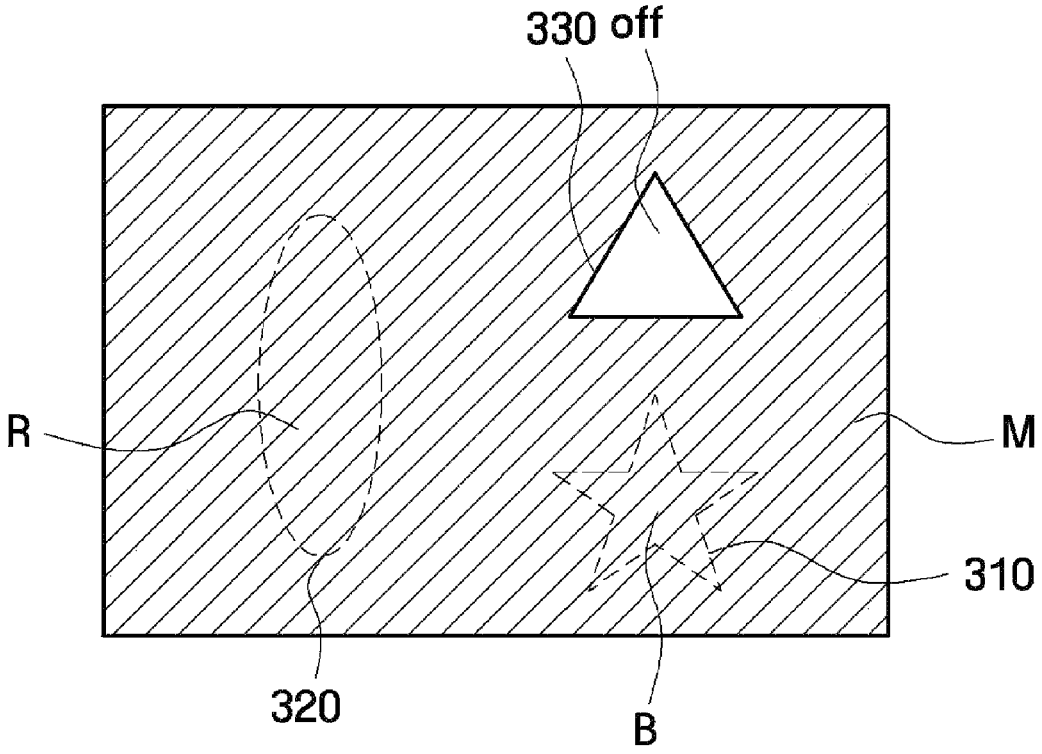

Referring to FIG. 6B, the first image signal representing magenta is transmitted to the liquid crystal panel 300. Here, the optical data, which includes the first information indicating that the first point light sources emitting magenta light should be turned on, is provided to the light source unit LU. Accordingly, the liquid crystal panel 300 displays the first FIG. 310 and the second FIG. 320 on a magenta background. Also, the colors of the first and second FIGS. 310 and 320 are displayed. Here, the color of the first FIG. 310 is blue and the color of the second FIG. 320 is red. Since the first information provided to the light source unit LU when the first image signal is transmitted to the liquid crystal panel 300 includes information indicating that only the first point light sources should be turned on, the second point light sources corresponding to the third FIG. 330, which represents green, remain turned off. In addition, since the first image signal does not include a signal for displaying green, green is not represented on a region of the liquid crystal panel 300 in which the third FIG. 330 is to be displayed.

Figure 6C:
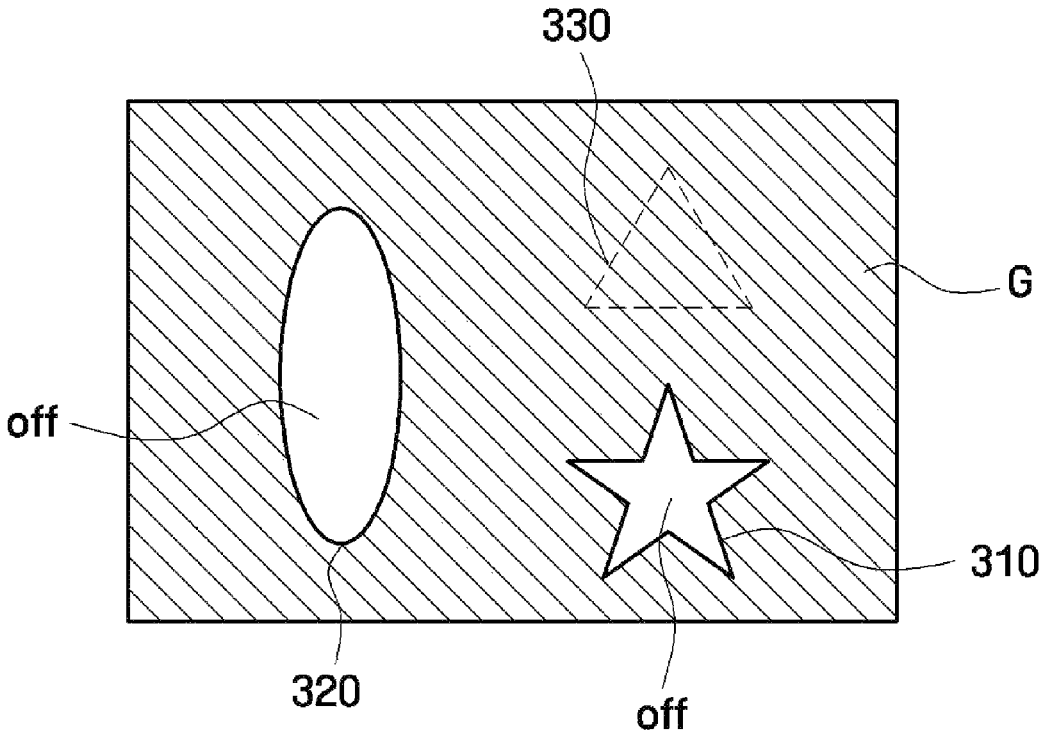

Referring to FIG. 6C, the second image signal representing green is transmitted to the liquid crystal panel 300. Here, the optical data, which includes the first information indicating that the second point light sources emitting green light should be turned on, is provided to the light source unit LU. Accordingly, the liquid crystal panel 300 displays the third FIG. 330 in green G on a green G background. Since the first information provided to the light source unit LU if the second image signal is transmitted to the liquid crystal panel 300 includes information indicating that only the second point light sources should be turned on, the first point light sources corresponding to the first and second FIGS. 310 and 320, which respectively represent blue and red, remain turned off. In addition, since the second image signal does not include signals for displaying blue and red, blue and red are not represented on regions of the liquid crystal panel 300 in which the first and second FIGS. 310 and 320 are to be displayed.

Through the above operations, a complete frame is displayed on the liquid crystal panel 300 as shown in FIG. 6A. To increase the margin of color representation, a period of time during which the first and second point light sources are turned off may be included between a time when the first point light sources are turned on and a time when the second point light sources are turned on.

FIG. 7 illustrates the scanning of one frame. For example, four rows of a frame are sequentially scanned. First, three rows M1_1 through M3_1 represent magenta (see 'a' in FIG. 7). That is, the first image signal is transmitted to the three rows M1_1 through M3_1, and the first point light sources corresponding to the three rows M1_1 through M3_1 are turned on. Further, the bottom row off_1 represents an off state in which the first and second point light sources are turned off.

Then, the three rows M1_1 through M3_1 are shifted downward by one row. The row M3_1 at the top of the liquid crystal panel 300 changes into a row off_1 (see 'b' in FIG. 7) in which the first and second point light sources are turned off so that the row M3_1, which previously represented magenta, can subsequently represent green (see 'c' in FIG. 7).

Next, the row off_1 (see 'b' in FIG. 7), which is located at the top of the liquid crystal panel 300 and in which the first and second point light sources are all turned off, changes into a row G1_1 (see 'c' in FIG. 7) in which the second point light sources are turned on and which represents green in response to the second image signal. Meanwhile, the first and second point light sources are all turned off in the row off_1 adjacent to the row G1_1 at the top of the liquid crystal panel 300, so that the row off_1 can represent green in a subsequent phase (see 'd' in FIG. 7). The first point light sources are turned on in remaining rows M1_1 and M2_1 such that the rows M1_1 and M2_1 represent magenta.

Next, the second point light sources are turned on so that the row G2_1 at the top of the liquid crystal panel 300 and the row G1_1 adjacent to the row G2_1 represent green (see 'd' in FIG. 7). In addition, the first and second point light sources are turned off in the row off_1 adjacent to the row G1_1 so that the row off_1 can represent green in a subsequent phase. The first point light sources are turned on in the remaining row M1_1 such that the row M1_1 represents magenta.

Next, the second point light sources are turned on in rows G1_1 through G3_1 such that the rows G1_1 through G3_1 represent green (see 'e' in FIG. 7). In addition, the first and second point light sources are turned off in the row off_1 adjacent to the row G1_1 so that the row off_1 can represent green in a subsequent phase.

Then, the three rows G1_1 through G3_1 are shifted downward by one row (see 'f' in FIG. 7). The row G3_1 (see 'e' in FIG. 7) at the top of the liquid crystal panel 300 changes into the row off_1 (see 'f' in FIG. 7) in which the first and second point light sources are all turned off so that the row G3_1, which represented green, can represent magenta in a subsequent phase.

Next, the row off_1 (see 'f' in FIG. 7), which is located at the top of the liquid crystal panel 300 and in which the first and second point light sources are all turned off, changes into the row M1_1 (see 'g' in FIG. 7) in which the first point light sources are turned on and which represents magenta in response to the first image signal. Meanwhile, the first and second point light sources are all turned off in the row off_1 adjacent to the row M1_1 at the top of the liquid crystal panel 300 so that the row off_1 can represent magenta in a subsequent phase. The second point light sources are turned on in the remaining rows G1_1 and G2_1 such that the rows G1_1 and G2_1 represent green.

Next, the first point light sources are turned on so that the row M2_1 at the top of the liquid crystal panel 300 and the row M1_1 adjacent to the row M2_1 can represent magenta (see 'h' in FIG. 7). In addition, the first and second point light sources are turned off in the row off_1 adjacent to the row M1_1 so that the row off_1 can represent magenta in a subsequent phase.

Next, all of the three rows M1_1 through M3_1 represent magenta (see 'a' in FIG. 7). Further, the first and second point light sources are turned off in the row off_1 adjacent to the row M1_1 so that the row off_1 can represent magenta in a subsequent phase. Through the above process, one frame is formed on the liquid crystal panel 300. A next frame is also formed on the liquid crystal panel 300 through the above process.

Figure 8:
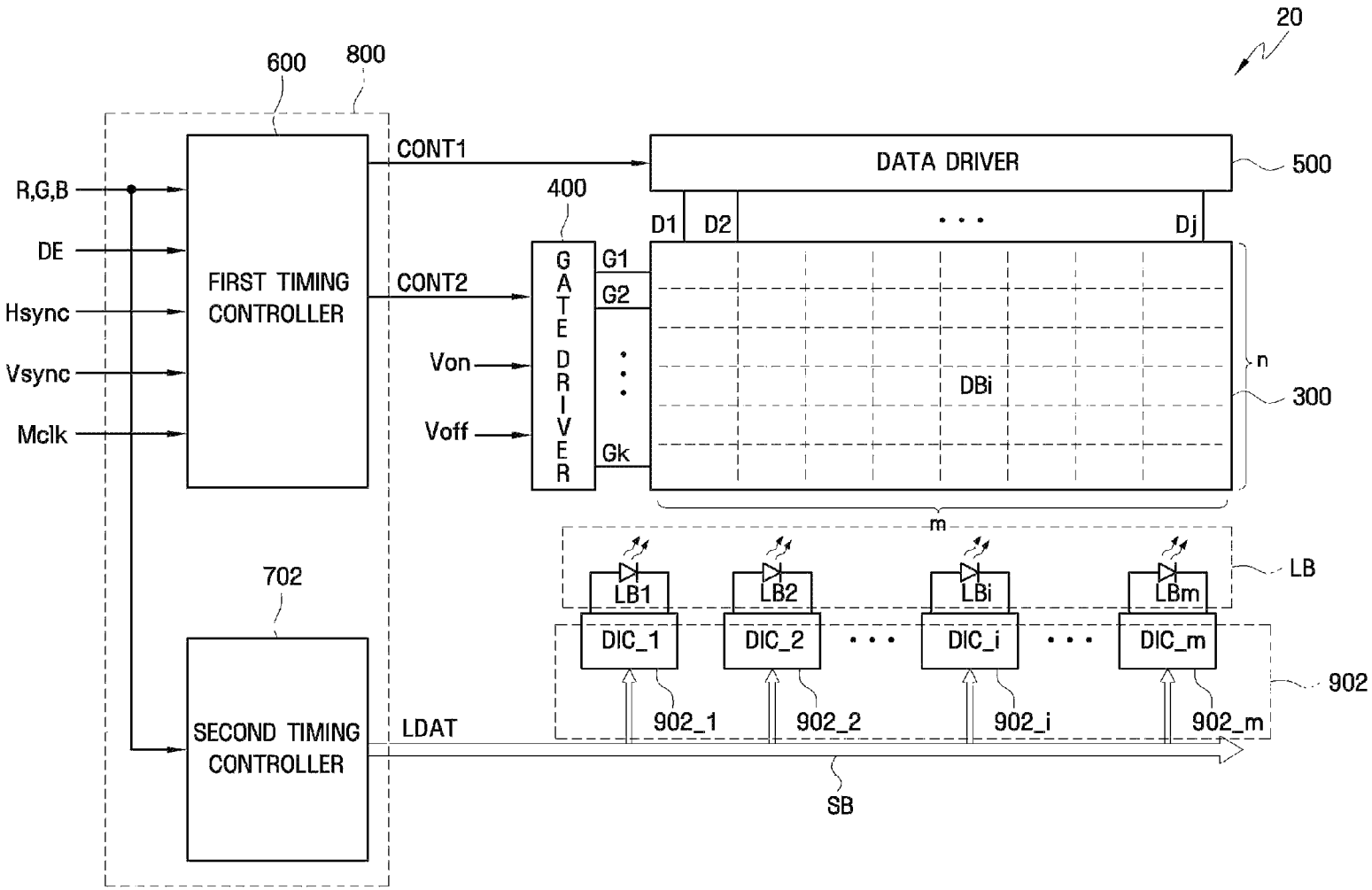
FIG. 8 is a block diagram of an LCD according to an exemplary embodiment of the present invention.
Figure 9:
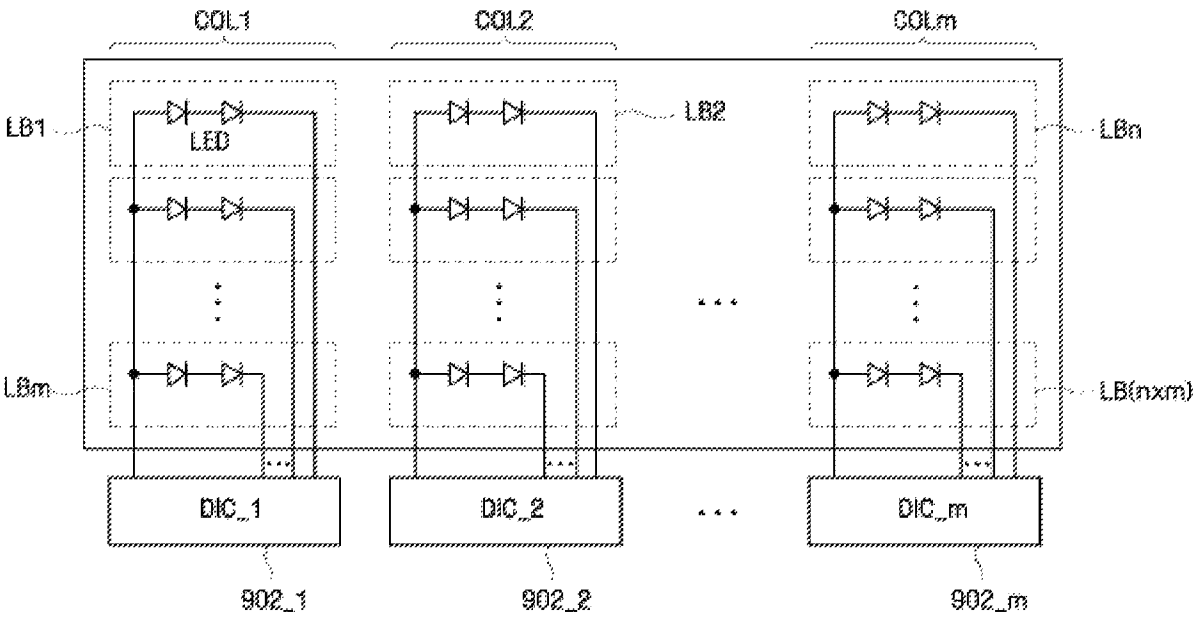
FIG. 9 is a block diagram of a light source unit and a light source driver shown in FIG. 8.

Hereinafter, an LCD 20 according to an exemplary embodiment of the present invention will be described with reference to FIGS. 8 through 10D. FIG. 8 is a block diagram of the LCD 20 according to an exemplary embodiment of the present invention. FIG. 9 is a block diagram of a light source unit LB and a light source driver 902 shown in FIG. 8. FIG. 10A, FIG. 10B, FIG. 10C, and FIG. 10D are conceptual diagrams illustrating operation of the LCD 20 according to an exemplary embodiment of the present invention. For simplicity, similar elements as those shown in the drawings described above are indicated by like reference numerals, and thus their description will be omitted.

Referring to FIG. 8 and FIG. 9, the LCD 20 according to the third exemplary embodiment may include a timing controller unit 800, the light source driver 902, a gate driver 400, a data driver 500, a liquid crystal panel 300, and the light source unit LB.

The light source driver 902 may include first through $m^{th}$ sub light source drivers 902_1 through 902_*m*. In addition, the light source unit LB may include first through $m^{th}$ light-emitting blocks LB1 through LBm arranged in m columns COL1 through COLm, each column COL1 to COLm having n light emitting blocks LB1 through LBn. Each of the first through $m^{th}$ light-emitting blocks LB1 through LBm may include first and second point light sources. The first and second point light sources included in each of the first through $m^{th}$ light-emitting blocks LB1 through LBm may be turned on and off according to first information. The first and second point light sources may be controlled by the light source driver 902. The first through $m^{th}$ light-emitting blocks LB1 through LBm may correspond to the first through $m^{th}$ sub light source drivers 902_1 through 902_*m*, respectively.

Specifically, a second timing controller 702 transmits optical data LDAT, which includes the first information and second information, to the light source driver 902. Thus, the optical data LDAT is transmitted to each of the first through $m^{th}$ sub light source drivers 902_1 through 902_*m*. Then, the first through $m^{th}$ sub light source drivers 902_1 through 902_*m* respectively control the first through $m^{th}$ light-emitting blocks LB1 through LBm according to the first and second information included in the optical data LDAT. Accordingly, the first and second point light sources included in each of the first through $m^{th}$ light-emitting blocks LB1 through LBm are turned on and off. That is, each of the first through $m^{th}$ sub light source drivers 902_1 through 902_*m* controls the first and second point light sources included in a corresponding one of the first through $m^{th}$ light-emitting blocks LB1 through LBm to be turned on and off.

Each of the first through $m^{th}$ sub light source drivers 902_1 through 902_*m* may control the first and second point light sources included in a corresponding one of the first through $m^{th}$ light-emitting blocks LB1 through LBm to be turned on and off on a row-by-row basis.

Figure 10A:
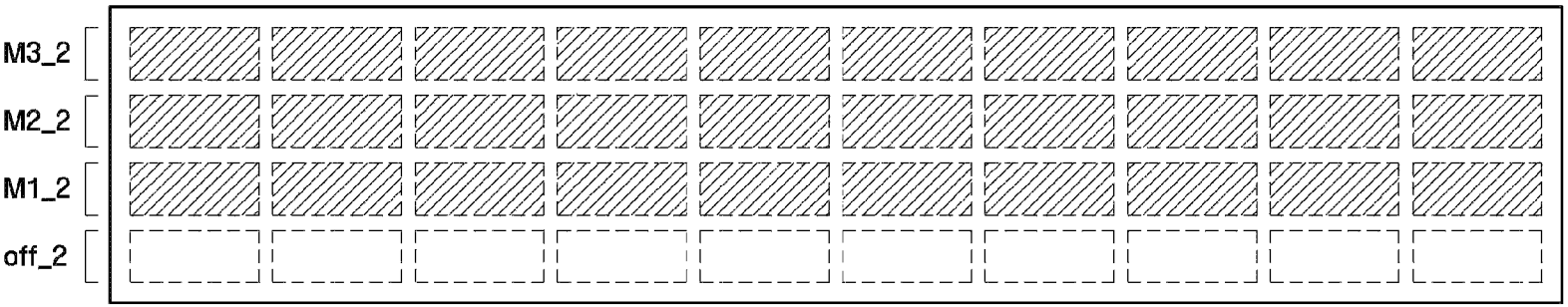
FIG. 10A, FIG. 10B, FIG. 10C, and FIG. 10D are conceptual diagrams illustrating operation of an LCD according to an exemplary embodiment of the present invention.

Specifically, referring to FIG. 10A, FIG. 10B, FIG. 10C, and FIG. 10D, at a time t1 shown in FIG. 10A, light-emitting blocks in first through third rows M3_2, M2_2, and M1_2 may be turned on, and a light-emitting blocks in a fourth row off_2 may be turned off. Here, the first point light sources in each light-emitting block of the first through third rows M3_2, M2_2, and M1_2 may be turned on so that the first through third rows M3_2, M2_2, and M1_2 represent magenta (see FIG. 10A).

Figure 10B:
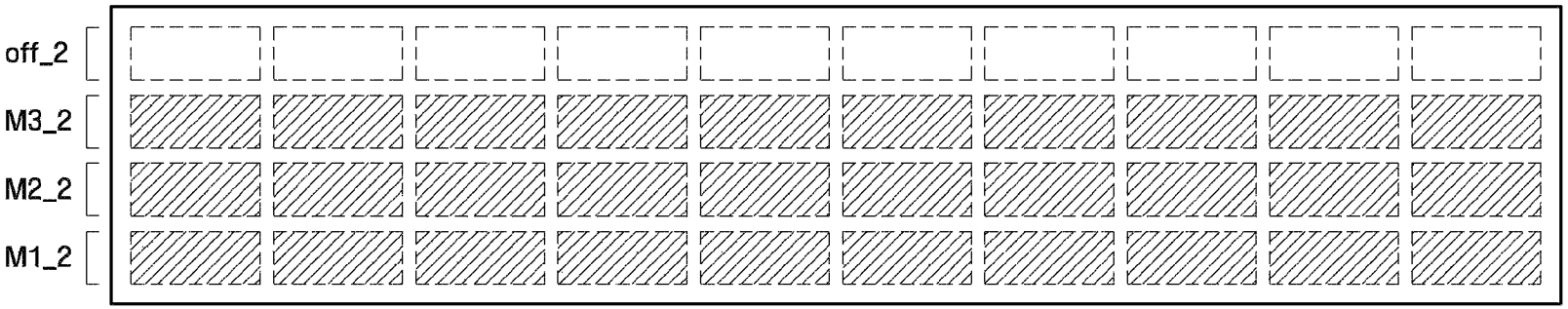

At a time t2 shown in FIG. 10B, the light-emitting blocks of the second through fourth rows M3_2, M2_2, and M1_2 may be turned on, and the light-emitting blocks of the first row off_2 may be turned off. Here, the first point light sources in each light-emitting block of the second through fourth rows M3_2, M2_2, and M1_2 may be turned on so that the second through fourth rows M3_2, M2_2, and M1_2 represent magenta (see FIG. 10B).

Figure 10C:
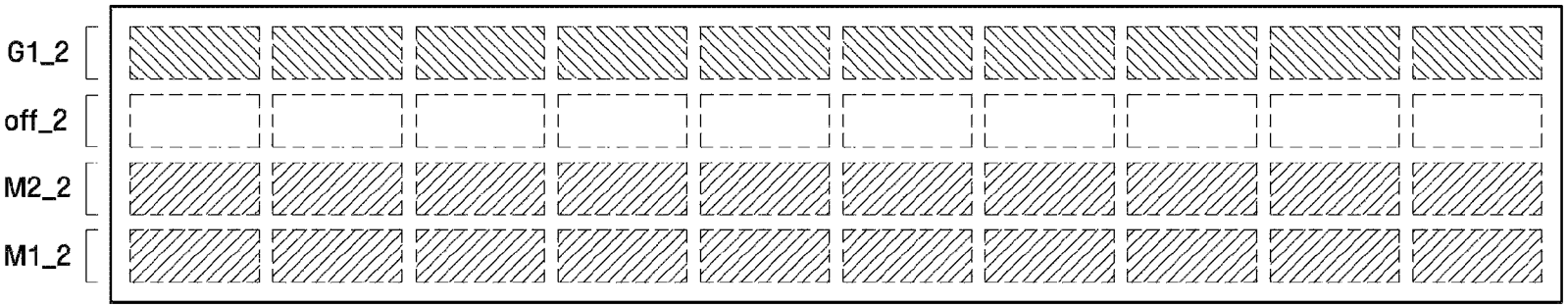

At a time t3 shown in FIG. 10C, the light-emitting blocks of the first row G1_2 and the third and fourth rows M2_2 and M1_2 may be turned on, and the light-emitting blocks of the second row off_2 may be turned off. Here, the second point light sources in each light-emitting block of the first row G1_2 may be turned on so that the first row G1_2 represents green. In addition, the first point light sources in each light-emitting block of the third and fourth rows M2_2 and M1_2 may be turned on so that the third and fourth rows M2_2 and M1_2 represent magenta (see FIG. 10C).

Figure 10D:
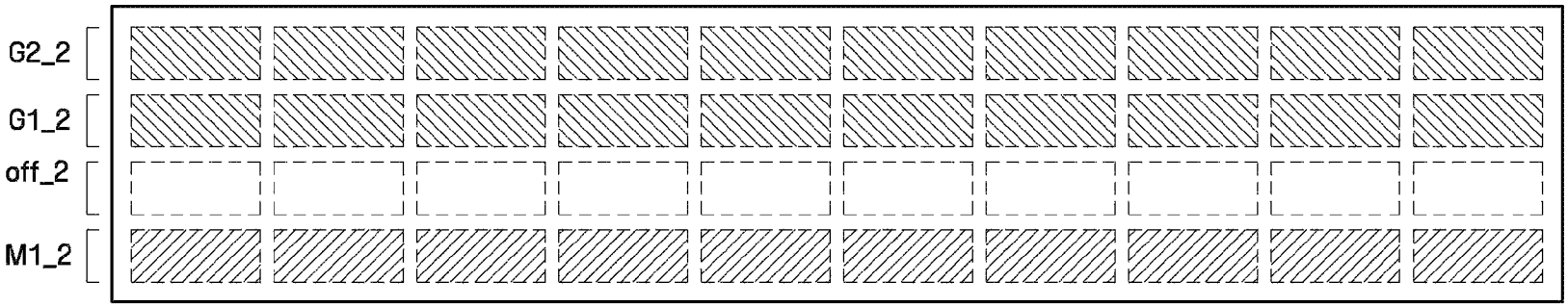

At a time t4 shown in FIG. 10D, the light-emitting blocks of the first and second rows G2_2 and G1_2 and the fourth row M1_2 may be turned on, and the light-emitting blocks of the third row off_2 may be turned off. Here, the second point light sources in each light-emitting block of the first and second rows G2_2 and G1_2 may be turned on so that the first and second rows G2_2 and G1_2 represent green. In addition, the first point light sources in each light-emitting block of the fourth row M1_2 may be turned on so that the fourth row M1_2 represents magenta (see FIG. 10D).

In this way, the first point light sources representing magenta and the second point light sources representing green may be sequentially turned on and off at different times and on a row-by-row basis. In addition, in any one row, the first and second point light sources may all be turned off between a time when the first point light sources are turned on and a time when the second point light sources are turned on. As a result, color reproducibility of the LCD 20 may be enhanced, thereby achieving superior display quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD), comprising:

a liquid crystal panel;

a light source unit to provide light to the liquid crystal panel, the light source unit comprising light-emitting blocks disposed in rows, each light-emitting block comprising a first point light source to emit a first light and a second point light source to emit a second light;

a first timing controller to transmit a first image signal to the liquid crystal panel and a second image signal to the liquid crystal panel;

a second timing controller to transmit optical data, the optical data comprising:

first information configured to turn on the first point light sources and the second point light sources at different times; and second information configured to turn off the first point light sources and the second point light sources, such that each light-emitting block sequentially emits no light for a period of time after the light-emitting block emits the first light and before the light-emitting block emits the second light; and a light source driver to control the first point light sources and the second point light sources according to the optical data, such that a light-emitting block emitting no light is disposed between a light-emitting block emitting the first light and a light-emitting block emitting the second light, wherein the first point light sources are turned on for at least a portion of a period of time in which the first image signal is transmitted to the liquid crystal panel, and the second point light sources are turned on for at least a portion of a period of time in which the second image signal is transmitted to the liquid crystal panel, wherein the second information is configured such that the period of time each light-emitting block emits no light substantially prevents mixing of the first light and the second light emitted therefrom, and wherein the light source driver comprises sub light source drivers respectively corresponding to the light-emitting blocks, wherein each of the sub light source drivers controls the first point light sources and the second point light sources included in a corresponding one of the light-emitting blocks to be turned on and off.

2. The LCD of claim 1, wherein the first timing controller transmits the first image signal and the second image signal to the liquid crystal panel at different times.

3. The LCD of claim 1, wherein the first information comprises information to turn off the second point light sources if the first point light sources are turned on and information to turn off the first point light sources if the second point light sources are turned on.

4. The LCD of claim 1, wherein a wavelength range of a first color represented by the first image signal is the same as a wavelength range of the first light emitted from the first point light sources.

5. The LCD of claim 1, wherein a wavelength range of a second color represented by the second image signal is the same as a wavelength range of the second light emitted from the second point light sources.

6. The LCD of claim 1, wherein the first light has a first wavelength range, and the second light has a second wavelength range that partially overlaps the first wavelength range.

7. The LCD of claim 6, wherein the first point light sources comprise light-emitting diodes that emit blue light, and the second point light sources comprise light-emitting diodes that emit green light.

8. A method of driving a liquid crystal display (LCD), the LCD comprising a liquid crystal panel, a light source driver, and a light source unit comprising light-emitting blocks, each light-emitting block comprising a first point light source to emit a first light, and second point light source to emit a second light, the method comprising:

transmitting a first image signal to the liquid crystal panel and a second image signal to the liquid crystal panel;

transmitting optical data to the light source driver, the optical data comprising:

first information configured to turn on the first point light sources and the second point light sources at different times; and second information configured to turn off the first point light sources and the second point light sources, such that each light-emitting block sequentially emits no light for a period of time after the light-emitting block emits the first light and before the light-emitting block emits the second light; and controlling the first point light sources and the second point light sources to be turned on and off according to the optical data, such that a light-emitting block emitting no light is disposed between a light-emitting block emitting the first light and a light-emitting block emitting the second light, wherein the first point light sources are turned on for at least a portion of a period of time in which the first image signal is transmitted to the liquid crystal panel, and the second point light sources are turned on for at least a portion of a period of time in which the second image signal is transmitted to the liquid crystal panel, wherein the second information is configured such that the period of time each of the light-emitting blocks emits no light substantially prevents mixing of the first light and the second light emitted therefrom, and wherein the light source driver comprises sub light source drivers respectively corresponding to the light-emitting blocks, wherein each of the sub light source drivers controls the first point light sources and the second point light sources included in a corresponding one of the light-emitting blocks to be turned on and off.

9. The method of claim 8, wherein the first image signal and the second image signal are transmitted to the liquid crystal panel at different times.

10. The method of claim 8, wherein the first point light sources emit light at a wavelength range according to first image information of the first image signal.

11. The method of claim 8, wherein the second point light sources emit light at a wavelength range according to second image information of the second image signal.

12. The method of claim 8, wherein the first light has a first wavelength range, and the second light has a second wavelength range that partially overlaps the first wavelength range.

* * * * *